US006385983B1

(12) United States Patent
Sakki et al.

(10) Patent No.: US 6,385,983 B1
(45) Date of Patent: May 14, 2002

(54) MULTIPURPOSE AIR CONDITIONING APPARATUS

(76) Inventors: Liv Sakki, Molstad, 2040 Kløfta; Laurits Mortensen, Rislokkeien 67 B, 0583 Olso; Erling Onsager, Holmenveien 63, 0376 Oslo; Alfred Brekke, Granstangen 28 c, 1051 Oslo, all of (NO)

( * ) Notice: Subject to any disclaimer, the term of this patent is extended or adjusted under 35 U.S.C. 154(b) by 0 days.

(21) Appl. No.: 09/646,178

(22) PCT Filed: Mar. 21, 1999

(86) PCT No.: PCT/NO99/00098

§ 371 Date: Sep. 14, 2000

§ 102(e) Date: Sep. 14, 2000

(87) PCT Pub. No.: WO99/51919

PCT Pub. Date: Oct. 14, 1999

(30) Foreign Application Priority Data

Mar. 24, 1998 (NO) ..... 981321

(51) Int. Cl.[7] ..... F25B 27/00

(52) U.S. Cl. ..... 62/238.7; 62/325; 62/324.1; 62/412; 62/427

(58) Field of Search ..... 62/325, 324.1, 62/412, 427, 238.7

(56) References Cited

U.S. PATENT DOCUMENTS 4,132,087 A * 1/1979 Goettl ..... 62/285
4,562,955 A * 1/1986 Horster et al. ..... 237/2 B
4,598,557 A 7/1986 Robinson
4,655,278 A * 4/1987 Seguin ..... 165/2
4,727,727 A 3/1988 Reedy
5,309,725 A * 5/1994 Cayce ..... 62/90
5,337,574 A 8/1994 Dick
5,388,421 A * 2/1995 Matsuoka ..... 62/209
5,706,664 A * 1/1998 Hara ..... 62/159
5,884,500 A * 3/1999 Wetzel ..... 62/259.1
5,975,191 A * 11/1999 Ohashi et al. ..... 165/43
6,038,879 A * 3/2000 Turcotte et al. ..... 62/325
6,155,074 A * 12/2000 Jung et al. ..... 62/506

FOREIGN PATENT DOCUMENTS

EP 0 279 143 8/1988

* cited by examiner

*Primary Examiner*—William Doerrler
*Assistant Examiner*—Mark Shulman
(74) *Attorney, Agent, or Firm*—Nixon & Vanderhye PC

(57) ABSTRACT

A multipurpose air conditioning apparatus is disclosed. The apparatus comprises fan assemblies (3, 13), a compressor (4), a condenser, an evaporator, a liquid and gas circuit, throttling means, air inlets, air outlets and means for redirecting the air flows. The apparatus is adapted such that the functions as condenser and evaporator are interchangeable for heating of air or cooling of air, respectively, in that the liquid flow in the liquid and gas circuit through the condenser, evaporator and the throttling means is reversible on demand. The apparatus comprises at least two separated units, Main and Annex, each having an air heat exchanger (2, 12), which operates as a combined condenser/evaporator, a fan assembly (3, 13), a fresh air inlet (7*a*, 17*a*), a room air inlet (7*c*, 17*c*) and a mixing chamber (x, 1*x*) upstream of the air heating exchangers (2, 12), an air outlet (7*b*, 17*b*) downstream of the air heating exchangers (2, 12) and means (9, 10, 19, 20) for redirecting the air flows.

16 Claims, 5 Drawing Sheets

Figure 1:
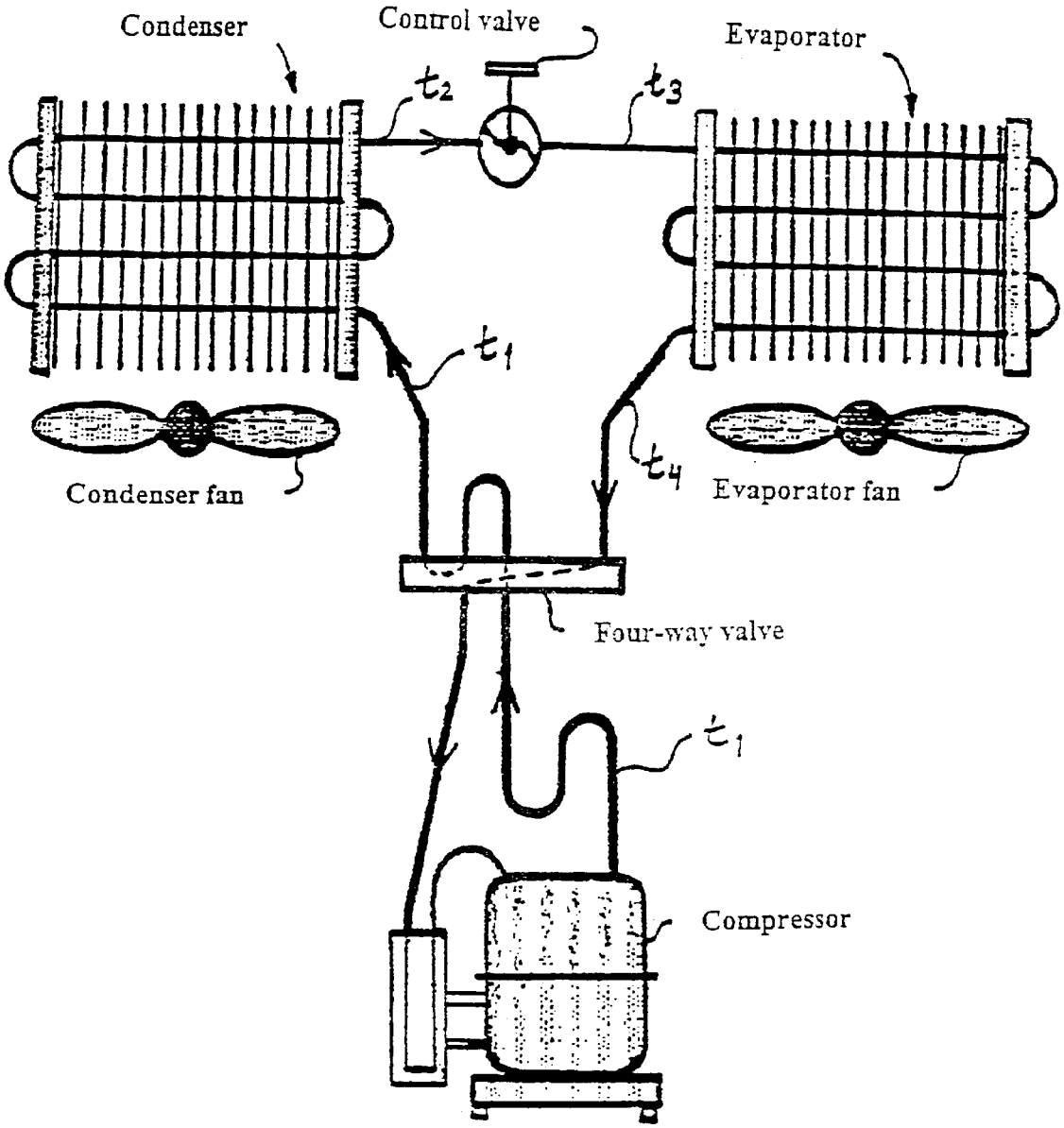

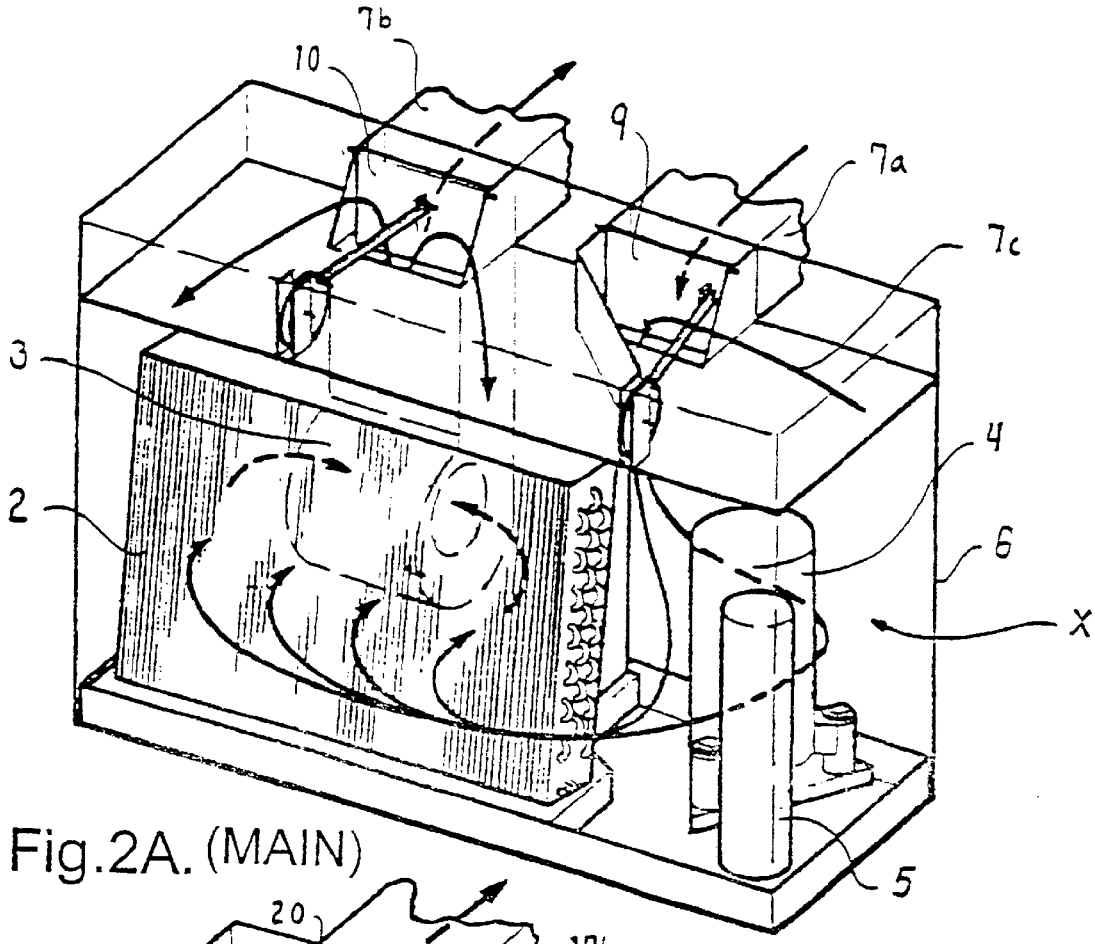
Fig.2A. (MAIN)
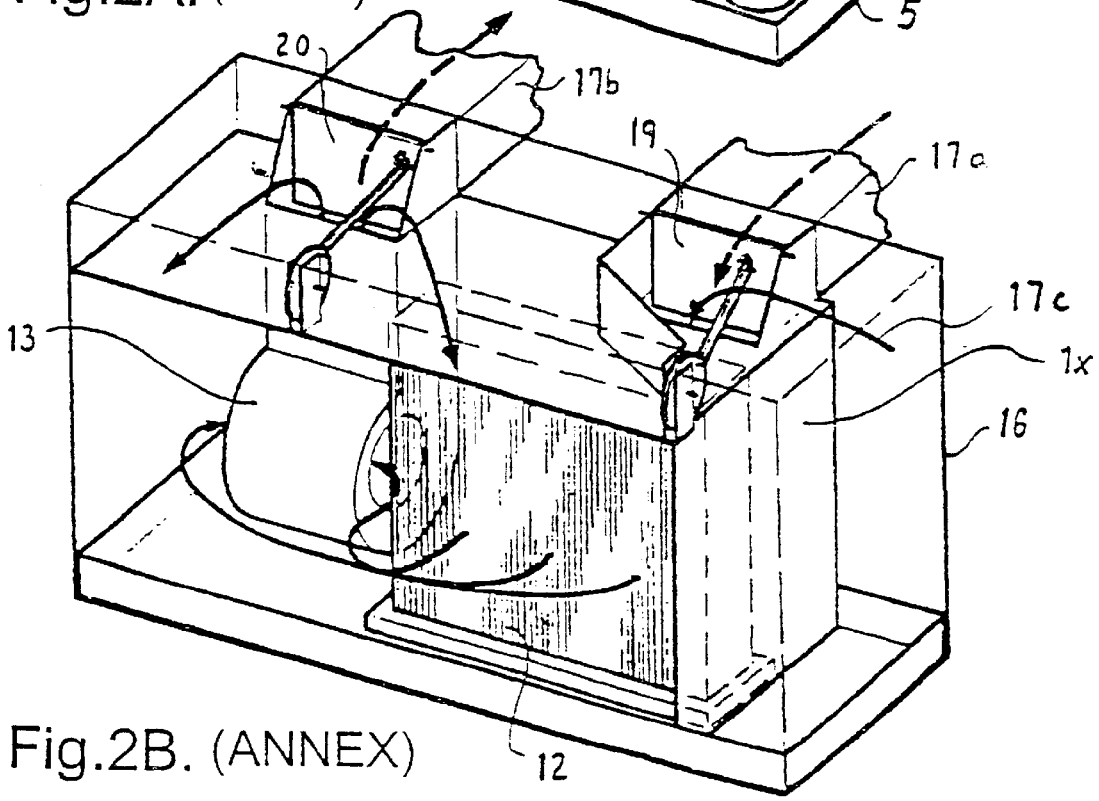
Fig.2B. (ANNEX)

MULTIPURPOSE AIR CONDITIONING APPARATUS

This application is the U.S. national phase of international application PCT/NO99/00098 filed Mar. 23, 1999 which designated the U.S.

The present invention relates to a multipurpose air conditioning apparatus for ventilation, heating of air and cooling of air, comprising fan assemblies, a compressor, condenser, evaporator, liquid/gas circuit, throttling means, air inlets and air outlets. The apparatus is adapted so as to make the functions of the condenser and the evaporator interchangeable for heating of air and cooling of air respectively, by making the liquid flow in the liquid/gas circuit through the condenser, evaporator and throttling means reversible according to requirements.

Further, the invention relates to a method of multipurpose conditioning of indoor air by means of the air conditioning apparatus above.

Further, reference is made to the later description of FIG. 1, which shows the state of the art.

The term "air conditioning" will in this context be taken to mean heating of air, cooling of air and ventilation.

At present, several possibilities exist for air conditioning combined with energy saving, and various equipment in the form of air conditioners is commercially available. One possibility is to install a heat pump. The most ordinary heat pumps today are the so-called split units (reversible air conditioner) and window units, which use air as the energy medium. Some air conditioners are adapted so as to draw energy or heat for the heat pump directly from the ground or a river or the sea. This type of heat pump is normally quite expensive to buy, and the cost of installation is very high.

In the cold parts of the world, it has become more and more common to build houses that are very airtight. Airtight houses require better ventilation, which is provided by the present invention.

It is generally agreed that the use of heat pumps will give the greatest reduction in energy consumption. Thus, there is a continued requirement for improvements in the areas of air conditioning and heat pumps, with regards to both indoor environment (allergy) in the form of ventilation, heat recovery and energy saving. Some countries support this through subsidies.

The present multipurpose air conditioning apparatus provides a completely new generation of air conditioning apparatus, with a number of functions designed to create a healthy and comfortable indoor environment the whole year round, at low costs. The present multipurpose air conditioning apparatus will, amongst other things, provide the following, functions:

1. Ventilation only.
2. Ventilation and heating of water.
3. Heating of water (heat pump air-water).
4. Heating of air (heat pump air-air).
5. Heating of air and ventilation.
6. Heating of air and ventilation at low outdoor temperatures (see point 13).
7. Heating of air (water-air).
8. Cooling of air ("air conditioning").
9. Cooling of air with ventilation.
10. Cooling of air, heating of water and ventilation.
11. Cooling of air and heating of water.
12. Cooling of air/ventilation in a room; heating/ventilation in an other room.
13. Rapid defrosting without disruption of the air flow (see point 6).

In addition, a number of other factors may be controlled, such as the pressure conditions in the room.

What distinguishes the apparatus is the number of available functions, and the simple manner in which the switching from function to function is accomplished. Further, the apparatus may be run at optimum performance at any indoor and outdoor conditions, both with regards to performance and energy conservation.

The air conditioning apparatus disclosed herein is based on a principle that has been developed for use with a number of various applications, such as: mobile air conditioners, window units, central units, compact units and split units. The units may be large or small, depending on the requirements.

When used for ventilation only, at comfortable outdoor temperatures, the apparatus may be used purely as a ventilating fan, optionally with means of air filtering By using infinitely variable fans in the two main units, called Main and Annex respectively, the indoor air pressure may be set to overpressure, balanced pressure or underpressure for all functions. Overpressure will be particularly desirable for those who suffer from allergies, underpressure for areas of contagion, such as hospitals, and balanced pressure in most other areas, such as living areas.

In connection with heating or cooling of air, it is possible to choose ventilation as an additional feature. When the outdoor temperature is low, it may be advantageous to mix the outdoor air and indoor air before it passes through the apparatus . By so doing, it is possible to make use of the energy contained in the warm indoor air, in order to improve the efficiency of the apparatus.

Whether the apparatus is run to heat air or cool it, it will be profitable to heat water at the same time, by making use of the excess heat.

According to the present invention, there is provided an air conditioning apparatus of the aforementioned type, characterised in that it comprises at least two separate units, Main and Annex, each with an air heat exchanger that acts as a combined condenser/evaporator, a fan assembly, a fresh air inlet, an indoor air inlet and a mixing chamber upstream of the heat exchangers, an air outlet downstream of the heat exchangers and means of redirecting the air flows, in addition to which the apparatus also includes bypass loops in the liquid/gas circuit with closing and throttling means.

Preferably, the circulation of liquid through the condenser and the evaporator is reversible by way of a four-way valve.

Advantageously, the liquid/gas circuit may be redirected to a heat exchanger in which the other medium is water, for the additional function of heating water, and this is preferably the part of the liquid/gas circuit that is located downstream of the compressor.

The two or more separate units may have a common compressor, and are connected via the liquid/gas circuit.

The units may be designed to be spaced apart, for instance at opposite ends of a room or on different floors, Annex advantageously placed high and Main advantageously placed low.

Alternatively, the apparatus may be a compact unit, with the units placed close together, either on top of each other or next to each other.

Preferably, the means of redirecting the air circulation include a through-apparatus channel between the room and the outside, with a rotatable damper for air redirection. The means of closing off the air circulation may include an air intake with a damper for indoor air, and an air intake with a damper for outdoor air and a 0–100% mixture of outdoor and indoor air.

The throttling means may be in the form of a capillary tube.

According to the present invention, there is also provided a method of the type described initially, which is characterised in that outdoor air, indoor air or a mixture of the two is directed to the upstream side of a combined condenser/evaporator, is drawn through the condenser/evaporator by the fan assembly, and displaced further on the downstream side of the condenser/evaporator, towards the room, the surroundings or both.

Figure 3:
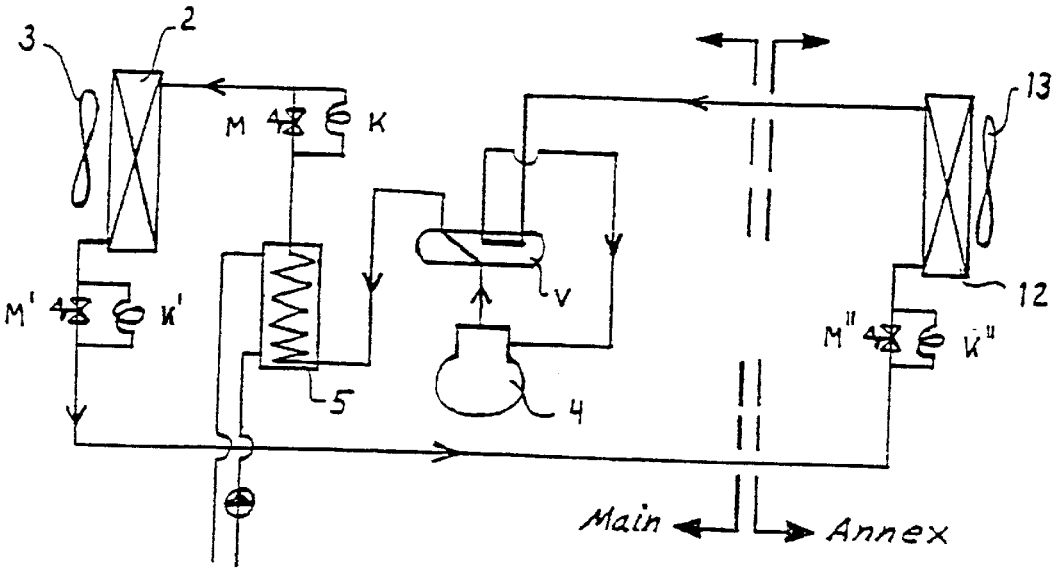
Figure 4:
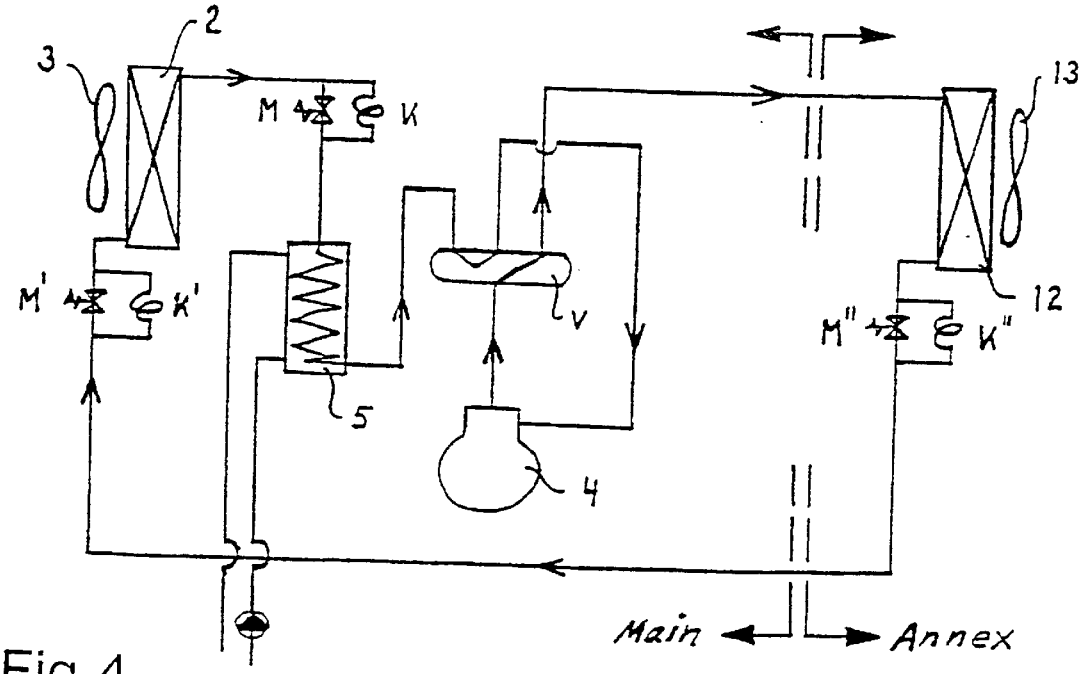

Other and further objectives, special characteristics and advantages will become apparent from the following description of presently preferred embodiments of the invention; this description being provided for descriptive purposes, without limiting the invention and with reference to the attached drawings, where:

FIG. 1 shows a schematic representation of a thermodynamic cyclic process that can be run both as an air conditioner and as a heat pump, and which represents the state of the art, FIGS. 2*a* and 2*b* show the air conditioning apparatus according to the invention, consisting of a primary apparatus called Main and a secondary apparatus called Annex, FIG. 3 schematically shows the flow of liquid/gas through the apparatus during normal operation, FIG. 4 schematically shows the flow of liquid/gas through the apparatus during reversed normal operation.

Figure 5:
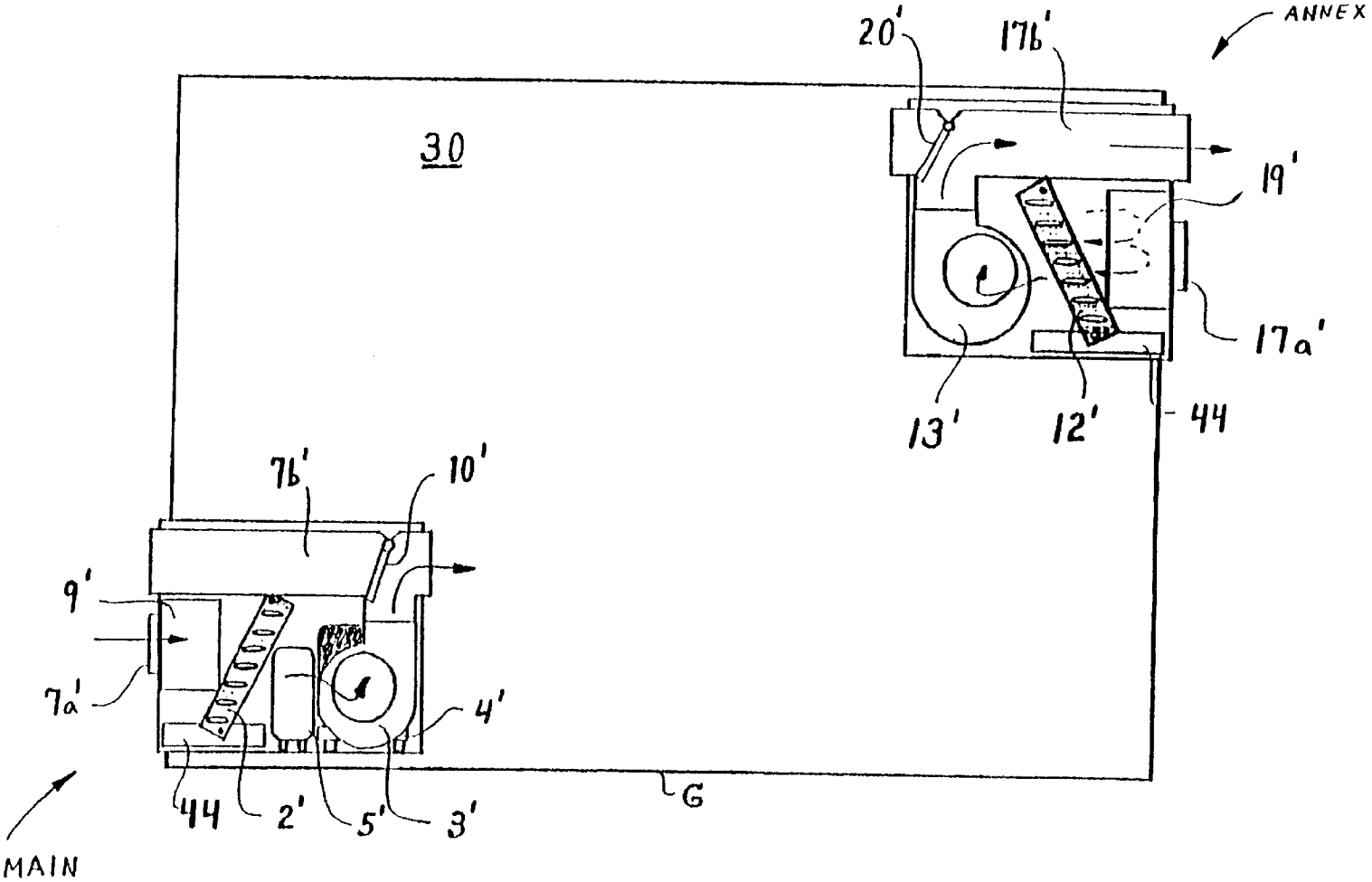
Figure 6:
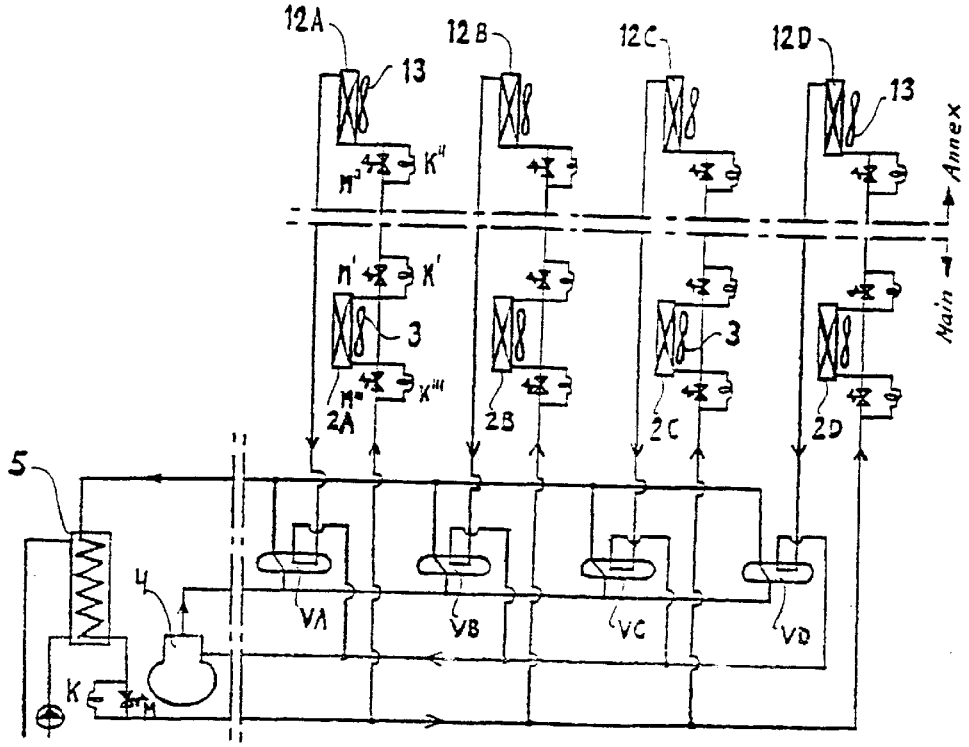
Figure 7:
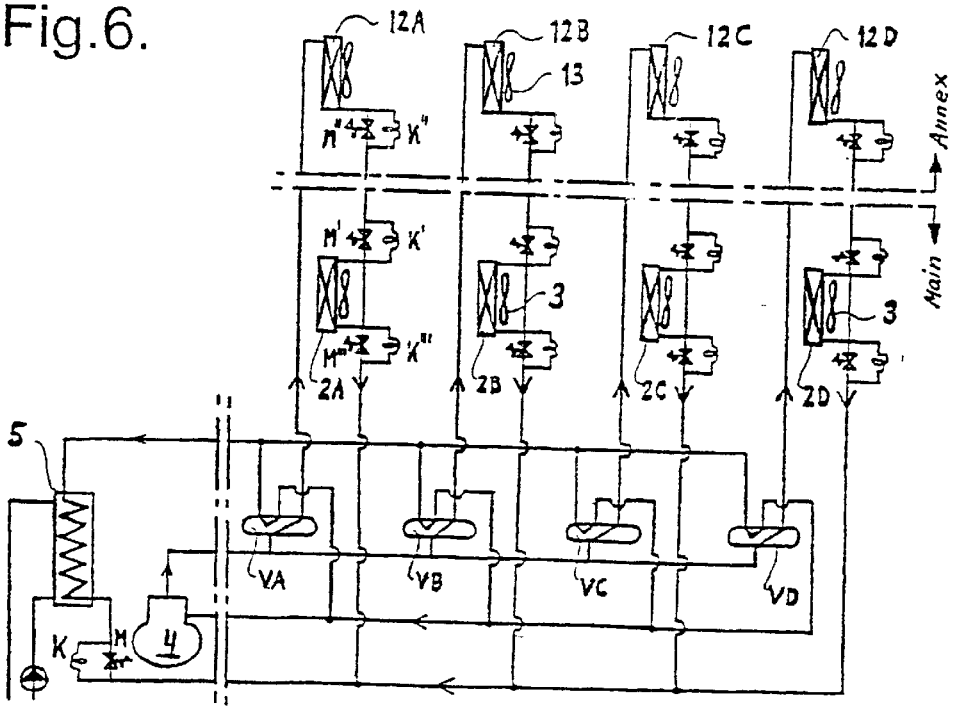

FIG. 5 schematically shows a second embodiment of a multipurpose air condition apparatus according to the invention, shown in one operating state as an example, FIG. 6 schematically shows the flow of liquid/gas through a multiple-room apparatus during normal operation and;

FIG. 7 schematically shows the flow of liquid/gas through a multiple-room apparatus during reversed normal operation.

For the purposes of this description, the term air conditioning will be used as a generic term for heating of air, cooling of air and air ventilation. Heating of air is based on the heat pump principle, cooling of air is based on that which is often termed air conditioning, and air ventilation is simply the supply of fresh air to a room, and the extraction of used air from the room. In addition, the apparatus may be used for heat recovery, in which the thermal energy in the extract air is transferred to the incoming air and/or to water or another medium that is to be heated up.

A heat pump is based on the principle of drawing energy from a medium such as water or air. The energy is transferred from the medium by a heat exchanger, the temperature of the energy-containing medium decreasing as it passes through the heat exchanger. The temperature of the other medium (circulating liquid/gas) increases correspondingly. The amount of energy represented by the temperature decrease is thus transferred to another medium by a corresponding increase in the temperature of the other medium. Thus it will be appreciated that it is the difference in temperature before and after passage through the heat exchanger and the flowrate of air that are of importance to the energy transfer, and the actual temperature level is not decisive. It will therefore make little difference if the temperature of the medium is decreased from +20 to +15, or if the temperature level is lowered from −5 to −10, as it is the difference (and flowrate of air) that matters. The main limitation for lowering the temperature of the medium is determined by the type of liquid/gas circulating through the apparatus. Traditionally, the gas used has been Freon 12, however this is increasingly being replaced by the gas R22 and the environmentally friendly gas 134A. Particular to this type of gas is the fact that it has a very low boiling point, for example 40 to −43° C. at atmospheric pressure.

An air conditioning apparatus is based on the reverse of the heat pump principle. In this case, the energy is extracted from the air in the room, thereby causing a decrease of the temperature of this air. This energy is carried to the outside with the extract air.

FIG. 1 may serve to represent the state of the art, and shows a schematic representation of the cyclic process of a cooling apparatus. The apparatus consists of a compressor, a condenser and an evaporator. The compressor is connected to the condenser via a conduit that carries a liquid medium. Further, the condenser is connected to the evaporator via another conduit, in which is located a control valve or a choke valve. The evaporator is further connected to the compressor via a conduit. The condenser is associated with a fan, which provides air flow through the condenser. Further, the evaporator is also associated with a fan that similarly provides air flow through the evaporator unit. During operation, the compressor compresses a gas, for example R22 or 134A to a certain pressure and a certain temperature, for example 16 bar and 40–45° C. This temperature is the temperature t1 of the cooling medium R22 at the inlet to the condenser. At the outlet of the condenser, the temperature t2 has fallen to approximately 30° C. However, the pressure is the same. This temperature decrease represents an amount of energy that has been transferred from the cooling medium to the air that has passed through the condenser by way of the condenser fan. The liquid cooling medium R22 then passes through the control valve, and is subjected to a substantial pressure drop, for example down to a pressure of 4.4 bar. This will give a corresponding, relatively dramatic drop in temperature down to approximately 3° C. (t3) at the inlet to the evaporator. By passing through the control valve, the liquid medium has been transformed into a form of spray, which will gasify completely by passing through the evaporator. At the outlet of the evaporator the temperature (t4) has risen to 9–10° C., as a result of the addition of energy from the outdoor air, which is being drawn in through the evaporator by the evaporator fan. The pressure at the out let will be approximately the same as that at the inlet to the evaporator. The gas is then directed back to the compressor, where it is recompressed. At the outlet of the compressor, it is gaseous and at a high pressure, ready for a new cycle.

The apparatus shown can in principle be used both as a cooling apparatus and as a heat pump, depending, on how condenser and evaporator are arranged. If the primary requirement is for a heat pump, the condenser and condenser fan are arranged in a manner so as to allow the air that passes through the condenser to pass into the room. The evaporator is placed so as to allow the air that passes through the evaporator via the evaporator fan to exit to the surroundings. If a cooling apparatus (air conditioner) is required, the evaporator is placed so as to allow the air that is displaced by the evaporator fan to pass into the room, while the air that is displaced by the condenser fan is directed to the surroundings.

The condenser and the evaporator are in principle constructed in the same way and the apparatus can be used both as a heat pump and as an air conditioning apparatus by, among other things, reversing the direction of flow of the cooling medium through the apparatus. In a situation where heating of air is required, the condenser is used as a condenser, and the evaporator as an evaporator. When air conditioning is desired, the former condenser is run as an evaporator, and the former evaporator as a condenser. A four-way valve will enable reversal of the direction of flow of the cooling medium and is for instance used in the so-called split units.

Incorporating a further function into the apparatus, for instance that of heating water for household use, is also possible. The cooling medium, which at the outlet of the compressor is in a gaseous state and at temperature t1 (e.g. 40–45° C.), may be directed to a water heat exchanger through a branch, at the inlet to which it will still be at the same temperature t1. The temperature at the outlet of the water heat exchanger will be lower than t1. The amount of energy represented by this decrease in temperature has been transferred to the water, the temperature of which has increased. This means that the temperature of the cooling medium gas at the inlet to the condenser is reduced relative to the temperature at the outlet of the compressor. As an example, the water that passes through the water heat exchanger may have an inlet temperature of −10° C. and an outlet temperature of +30° C.

Reference is now made to FIGS. 2*a* and 2*b*. These depict a first embodiment of the multipurpose air conditioning apparatus according to the invention. The air conditioning apparatus consists of a primary unit called Main, and a secondary unit called Annex. Main comprises an enclosed casing 6 with air ducts 7*a*, 7*b* that can carry air to and from the casing 6. The air ducts 7*a*, 7*b* are provided with infinitely variable dampers 9, 10 that can be set at any position between completely closing off the ducts 7*a*, 7*b*, and leaving the ducts 7*a*, 7*b* fully open. The ducts 7*a*, 7*b* have been designed to each have three openings, and the dampers 9, 10 determine through which openings the air will flow. The openings in each duct 7*a*, 7*b* lead to the open air, to the room and to a mixing chamber x on the inside of the casing 6 respectively. The dampers 9, 10 may be of a flap type, an orifice type or of any known, suitable design.

An air heat exchanger 2 and a fan assembly 3 are placed inside the casing 6. The fan 3 is capable of drawing air through the casing 6, and the direction of the air flow is dependent on the positions of the dampers 9, 10. Main further comprises a compressor 4 and a water heat exchanger 5. The mixing chamber x is located upstream of the air heat exchanger 2. In the mixing chamber, the outdoor air is mixed with the indoor air to a greater or lesser extent.

It should be noted that the air heat exchanger 2 cane be used both as an evaporator and a condenser, depending on the desired operating state and function.

The secondary unit, called Annex, like Main has a casing 16 with ducts 17*a*, 17*b*. The ducts 17*a*, 17*b* have dampers 19, 20 respectively, for directing the air flow to and from the unit. The ducts 17*a*, 17*b* have, as in Main, three openings each; one leading to the open air, one leading to the room, and the third opening from duct 17*a* leading to the mixing chamber 1*x* and from the duct 17*b* to the fan outlet 13. The dampers 19, 20 are infinitely variable, and can be set to any intermediate position between completely closed and fully open. The casing 16 further incorporates an air heat exchanger 12 that can act both as an evaporator and a condenser, depending on the requirements. As in Main, the casing 16 includes a fan assembly 13 for drawing air through the apparatus. Main and Annex are connected through conduits (not shown) for carrying cooling medium, such as R22. Both units are further connected to the common compressor 4. Annex also has a mixing chamber 1*x* for mixing of fresh air and indoor air. This is also located upstream of the air heat exchanger 12. The dampers 19, 20 may be of any of the types mentioned for the dampers 9, 10.

Reference is now made to FIGS. 3 and 4, which illustrate the gas/liquid flow in the piping system of the multipurpose air conditioning apparatus in various situations. In addition to what has been described earlier, this also includes bypass loops with one solenoid valve M" for short-circuiting the flow past a throttling means K" or capillary tube that is located between the condenser 2 and the evaporator 12, but close to the latter. A further bypass loop with solenoid valve M' and throttling means K' (capillary tube) is included in the same circuit, but close to the condenser 2. A further bypass loop is included between the water heat exchanger 5 and the condenser 2, which comprises yet another throttling means K or capillary tube and a short-circuit line with a solenoid valve M. The remaining components are as described earlier, including a four-way valve V for directing the liquid/gas flow to various circuits and in various directions. FIG. 3 shows normal operation of the apparatus, e.g. with a condenser 2 with fan 3 and an evaporator 12 with fan 13, and with the water heat exchanger 5 acting as a condenser. The condenser 2 and the evaporator 12 are arranged according to the desired use.

FIG. 4 also shows normal operation, but with a reversed direction of flow for the liquid/gas, thereby achieving the opposite function of that shown in FIG. 3 without having to rearrange any components. Consequently, through this reversed operation the former condenser 2 has become an evaporator, and correspondingly the former evaporator 12 has become a condenser. Further, the water heat exchanger 5 also acts as an evaporator.

FIG. 3 also shows a situation where the apparatus can be run with two "evaporators" 2,12 complete with fans 3, 13 and with one water heat exchanger 5 using water from the mains acting as a condenser. In this way, both "evaporators" 2, 12 act as air conditioning apparatuses, and the water heat exchanger 5 is used for heating of water. In this situation, the throttling means K', K" between the two "evaporators" 2. 12 are bypassed through the solenoid valves M', M" opening the bypass loop. Similarly, the solenoid valve M is closed between the water heat exchanger 5 and one evaporator 2, while throttling means K is open.

FIG. 4 shows a parallel to the above situation, but with two heat pump installations that include two "condensers" 9, 12 complete with fans 3, 13. Here, the water heat exchanger 5 acts as the evaporator of the installation. Cold water with a minimum temperature of +8° C. is fed to the water heat exchanger 5, where it lowers the temperature of the water. Thus energy is drawn from the water. The positions of the throttling means K, K', K" and the solenoid valves M, M', M" are the same as in FIG. 3, for cooling of air.

Reference is now made to FIG. 5 for a general description of a version of the air conditioning apparatus placed in a room 30. Annex, which will normally act as a cooling apparatus, is located at a distance from the floor G. For illustration purposes, the size of Annex is greatly exaggerated in proportion to the room 30. The unit does not have to be placed in the room at all, but may be connected to the ducting system for the 30 room, all according to the type of room or building in question. The devices that can also be found in FIGS. 2*a* and 2*b* have been given the same reference numbers, with the addition of markings. Annex comprises a heat exchanger 12' for the passage of air. Circulation of the air is provided by the fan 13', which draws air either from the outside through the duct 17*a*', or through a damper 19' that allows passage of air from the room 30, or both. The air is passed on to the duct 17*b*' by the fan 13', and directed through this by the damper 20', either to the surroundings outside the room or to the room 30. Thus, the damper 20' can direct the air partly or in full to the room and/or the surroundings. A drip tray 44 is placed underneath the heat exchanger 12' for collection of any condensation that may drip from the heat exchanger.

Main is located at the other end of the room 30, preferably at floor level G. Main comprises a compressor 4', and a heat exchanger 2' with a drip tray 44 underneath for collection of any condensation that may drip from the heat exchanger 2'. Main includes a duct 7*a*' that leads to open air, and a damper 9' that can be opened to admit air from the room 30. The fan 3' draws air through Main, and leads it to the duct 7*b*', after which it is directed fully or partly by the damper 10', either to the room 30 or to the surroundings.

As an extra function, Main can include yet another heat exchanger 5, which will provide the opportunity for heating of water, by use of the cooling medium in the piping circuit. This allows extra utilisation of the energy. A parallel to this is found in the description of FIGS. 3 and 4.

FIG. 5 shows one of the functions of the apparatus, ventilation only at balanced room pressure, which will normally be in use when the outside temperature is comfortable, for example around 18–25° C. In this situation, the fans 3' and 13' are running, but the compressor 4' is at a standstill, and consequently the heat exchanger 2', 12' is not operating.

It will be appreciated that an infinite number of settings exist for the machine, all according to what is required. Thus it will be appreciated that the dampers 9', 10' can be at an infinite number of intermediate positions that allow greater and lesser amounts of air to be sent into the room 30 or to the surroundings. This also holds true for the Annex dampers 19' and 20', which can be regulated to more or less open positions in order to control the direction of the air flow. Moreover, the speed of the fan can be used to control the amount of air that passes through the apparatus, be it outdoor air or indoor air.

In a further embodiment of a multipurpose air conditioning apparatus according to the invention, main and Annex may be located close together. This apparatus will have the same functions as the apparatus described in connection with FIG. 2. There is however a danger of "short-circuiting" the air flows, and the arrangement of the air inlets and outlets must be considered carefully.

Reference is now made to functions 1 to 13, listed on page 2. These will be described briefly, with reference to FIGS. 2*a* and 2*b*.

1: Ventilation only.

Main:

Compressor 4 is shut down. Fan 3 is operating, no heating or cooling of the air stream.

Damper 9 for air from room is fully open (Fresh air in is completely closed).

Damper 10 for air out is fully open. (Air from room is completely closed).

Annex:

Fan 13 is operating. Damper 19 for fresh air fully open. (Air from room completely closed). Damper 20 for air to room fully open. (Air out completely closed). The air flow is controlled by infinitely variable fans. Possibility of overpressure, underpressure or balanced pressure in the room. Note further that the air ducts, dampers and fans advantageously have identical dimensions and are arranged identically in Main and Annex. In the case of ventilation only, the same functions are interchangeable between Main and Annex.

2: Ventilation only and heating of water.

Main:

Compressor is 4 operating. Water cooled heat exchanger 5 acts as a condenser. Air cooled heat exchanger 2 acts as an evaporator. Fan 3 is operating. Damper 9 for air from room is fully open. (Fresh air in is completely closed). Damper 10 for air out is fully open. (Air to room is completely closed).

Annex:

Fan 13 is operating.

Damper 19 for fresh air in is fully open. (Air from room is completely closed.)

Damper 20 for air to room is fully open. (Air out is completely closed).

The air flow is controlled by infinitely variable fans.

3: Heating of water (heat pump) from air to water.

Main:

Compressor 4 is operating, water cooled heat exchanger 5 acts as a condenser.

Air cooled heat exchanger 2 acts as an evaporator with the fan 3 operating.

Damper 9 for fresh air in is fully open. (Air from room is completely closed).

Damper 10 for air out is fully open. (Air from room is completely closed).

Annex:

Fan 13 is shut down. Dampers 19 and 20 for air in/air out are closed.

4: Heating of air (heat pump) standard (air to air).

Main:

Compressor 4 is operating. Air cooled heat exchanger 2 act as an evaporator with the fan 3 operating.

Damper 9 for fresh air in is fully open. (Air from room is completely closed).

Damper 10 for air out is fully open. (Air to room is completely closed).

Annex:

Air cooled heat exchanger 12 acts as a condense, with the fan 13 operating.

Damper 19 from room is fully open. (Fresh air in is completely closed).

Damper 20 to room is fully open. (Air out is completely closed).

5: Heating of air and standard ventilation.

Main:

Compressor 4 is operating. Air cooled heat exchanger 2 acts as an evaporator with the fan 3 operating.

Damper 9 for air from room is fully open. (Fresh air in is completely closed).

Damper 10 for air out is fully open. (Air to room is completely closed).

Annex:

Air cooled heat exchanger 12 acts as a condenser with the fan 13 operating.

Damper 19 for fresh air in is fully open. (Air from room is completely closed).

Damper 20 for air to room is fully open. (Air out completely closed).

6: Heating of air and ventilation at low outdoor temperatures.

Main:

Compressor 4 is operating. Air cooled heat exchanger 2 acts as a condenser with the fan 3 operating (for instance at 40% capacity).

Damper 9 for fresh air in is fully open.

Damper 10 for air to room is fully open. (Air out completely closed).

Annex:

Air cooled heat exchanger 12 acts as an evaporator with the fan 13 operating at full capacity.

Damper 19 is partly open, and will give a mixture of for instance 60% fresh air and 40% air from the room, which is drawn through the evaporator and passed out through damper 20, which is fully open. (Air to room is completely closed).

Defrosting required—see point 13.

7: Heating of air from water to air.

Condition:

Water at a temperature of minimum +8° C. must be available, as a source of heat.

Main:

Water cooled heat exchanger 5 acts as an evaporator. Air cooled heat exchanger 2 gives no heating/cooling effect. The fan 3 is operating.

Damper 9 for air from room is fully open. (Fresh air is completely closed).

Damper 10 for air out is fully open. (Air from room is completely closed).

Annex:

Air cooled heat exchanger 12 acts as a condenser. The fan 13 is operating.

Damper 19 for fresh air in is fully open. (Air from room is completely closed).

Damper 20 for air to room is fully open. (Air out is completely closed).

8: Cooling of air (air conditioning).

Main:

Compressor 4 is operating. Heat exchanger 2 for air acts as a condenser. Fan 3 is operating.

Damper 9 for fresh air in is fully open. (Air from room is completely closed).

Damper 10 for air out is fully open. (Air to room is completely closed).

Annex:

Air cooled heat exchanger 12 acts as an evaporator. Fan 13 is operating.

Damper 19 for air from room is fully open. (Fresh air in is completely closed).

Damper 20 for air to room is fully open. (Air out is completely closed).

The air flow is controlled by infinitely variable fans.

9: Cooling of air with ventilation.

Main:

Compressor 4 is operating. Air cooled heat exchanger 5 acts as a condenser with the fan 3 operating.

Damper 9 is partly open, and will let a mixture of fresh air and air from the room out through damper 10, which is fully open. (Air to room is completely closed).

Annex:

Air cooled heat exchanger 12 acts as an evaporator with the fan 13 operating.

Damper 19 is partly open, and will give a mixture of fresh air and air from the room, which is drawn through the evaporator and sent out into the room through the damper 20, which is fully open. (Air out is completely closed).

10: Cooling of air, heating of water and ventilation.

Main:

Compressor 4 is operating. Heat exchanger 5 for water acts as a condense. The fan 3 is shut down. There is no air flow through Main until the heated water has reached the desired temperature. At that point, the fan 3 will start up, and air cooled heat exchanger 2 takes over as condenser.

Damper 9 for fresh air in is partly open, and will give a mixture of fresh air and air from the room, which is drawn through the condenser and sent onwards out through damper 10, which is fully open. (Air to room is completely closed).

Annex:

Air cooled heat exchanger 12 acts as an evaporator with the fan 13 operating Damper 19 is partly open, and will give a mixture of fresh air and air from the room, which is drawn through the evaporator and sent out into the room via damper 20, which is fully open. (Air out is completely closed).

11: Cooling of air and heating of water.

Main:

Compressor 4 is operating. Water cooled heat exchanger 5 acts as a condenser. The fan 3 is shut down. There is no air flow through Main until the heated water has reached the desired temperature. At that point, the fan 3 will start up, and air cooled heat exchanger 2 takes over as condenser.

Damper 9 for fresh air in is fully open. (Air from room is completely closed).

Damper 10 for air out is fully open. (Air to room is completely closed).

Annex:

Air cooled heat exchanger 12 acts as an evaporator. The fan 13 is operating.

Damper 19 for air from room is fully open. (Fresh air in is completely closed).

Damper 20 for cooled air to room is fully open. (Air out is completely closed).

The air flow is controlled by infinitely variable fans.

12: Cooling of air/ventilation in one room, heating/ventilation in another room.

Some rooms in a building may have added heat, and require ventilation through most of the year (e.g. computer rooms etc.), while adjacent rooms require addition of heat/ventilation. The present air conditioning apparatus can meet both requirements in a very energy saving manner. By placing Main in one room and Annex in the other (arbitrarily), the cooling/heating of air can be carried between the rooms, with separate ventilation for each room. This is possible because the air ducts in and out, dampers and fans are preferably dimensioned and arranged very similarly in Main and Annex, and the functions of the heat exchangers for air are easily interchangeable.

Main is Placed in a Room to be Cooled:

Compressor 4 is operating. Air cooled heat exchanger 2 acts as an evaporator. Fan 3 is operating.

Damper 9 is partly open, and will give a mixture of fresh air and air from the room, which is drawn through the evaporator and through the damper 10, which is partly open and distributes air out and to the room.

Annex is Placed in a Room to be Heated:

Air cooled heat exchanger 12 acts as a condenser, the fan 13 is operating.

Dampers 19 and 20 are in the same positions as dampers 9 and 10 in Main.

13: Rapid defrosting without disruption of the air flow (see point 6).

The present air conditioning apparatus can be used as a heat pump "air to air", at outdoor temperatures down to −25° C.

Main:

Air cooled heat exchanger 2 acts as a condenser. The fan 3 is operating with a reduced air flow.

Damper 9 for fresh air in is fully open. (Air from room is completely closed).

Damper 10 for air to room is fully open. (Air out is completely closed).

Annex:

Air cooled heat exchanger 12 acts as an evaporator. The fan 13 is operating.

Damper 19 for fresh air in is partly open. Air from the room is mixed with fresh air and gives a higher temperature than that of the outside air. The air mixture is drawn through the evaporator and further out through the damper 20, which is fully open. (Air to room is completely closed).

Due to the low outside temperature and the high relative humidity, a thin layer of ice will form on the evaporator after a while. A sensor sends a signal to the four-way valve, which redirects hot gas from Main to Annex. The hot gas heats up heat exchanger 12 in Annex, so that the ice becomes droplets of water that run into a drip tray and are drained away. The process takes less than a minute, after which the sensor sends a new signal, and the four-way valve changes the process back to its previous setting. During the defrosting, no air flows have changed direction and no dampers have altered their position. The redirection of the process will cause a temperature decrease in Main that can be measured by sensitive instrumentation, but which will not be noticeable in the room, due to the short duration and the very small temperature difference.

The apparatus provides great flexibility with regards to the number of rooms to be conditioned. A hospital or a school with a large number of rooms may be envisaged. The requirements may be very different from room to room, with respect to the desire for heating, cooling, and possibly specific pressure conditions. The apparatus can further be arranged so as to make use of the energy that exists at any time, for instance by transferring the thermal energy in an overheated room into a cool room, a situation that often arises in buildings with rooms both on the sunny side and the shady side. A parallel to this in the southern parts of the world, would be to make use of the thermal energy from rooms that are cooled by air conditioning apparatus to heat up the hot water or a swimming pool. Normally, this energy dissipates to the atmosphere.

FIGS. 6 and 7 schematically show the flow of liquid/gas through a multiple-room apparatus during normal operation and reversed normal operation respectively. The multiple-room apparatus has a common compressor 4 and water heat exchanger 5, in addition to a first solenoid valve M with a bypass loop that includes throttling means in the form of capillary tube K close to the exit from the water heat exchanger 5. More specifically, the figures show a 4-room apparatus with two heat exchangers 2A, 12A; 2B, 12B; 2C, 12C; 2D, 12D complete with fans 3, 13 associated with each room, which heat exchangers may alternately be used as evaporators and condensers. Liquid/gas is directed to the respective rooms by four-way valves VA; VB; VC; VD respectively. Each heat exchanger 19A; 12B, 12C; 12D in Annex further has a solenoid valve M", with a bypass loop that includes throttling means in the form of capillary tube K" close to the entrance to the heat exchanger. A solenoid valve M'; M" with associated bypass loop and respective throttling means in the form of capillary tube K'; K" has been placed in the piping circuit at the entrance and exit of each of the heat exchangers 2A; 2B; 2C; 2D in Main. Each of the heat exchangers in Main also has a fan 3 associated with it. Even though the four-way valves VA; VB; VC; VD in FIGS. 6 and 7 are shown in the same position, it must be appreciated that these may be set individually, in accordance with the requirements of the various rooms. Thus Main and Annex can act as an evaporator and a condenser independently of each other in a multiple-room situation.

The construction of a multiple-room apparatus is in principle the same as for the apparatus shown in FIGS. 3 and 4, and the number of rooms may be anything from one and up. The maximum number of rooms is determined by the capacity of the compressor and the distance from the compressor to the respective rooms. However, one difference should be noted. Another solenoid valve M'" with associated bypass loop and capillary tube has been included in the circuit, due to the distances between the components of the apparatus.

Further, it should be appreciated that Main in some instances can be located outside, as a common unit for several Annexes placed in the various living areas. Alternatively, the opposite may be the case, with a common Annex in one room or on the outside, and with respective Mains in the living areas. However, this is determined by the requirements that have to be met by the apparatus, and the climatic conditions. An example may be a hospital in a very hot climate, which only requires cooling (air conditioning). One Annex is placed in each room in order to provide cooling, while a common Main is located at a distance from the rooms, where it may be used for heating water.

What is claimed is:

1. Multipurpose air conditioning apparatus for ventilation, heating of air, and cooling of air, comprising a compressor, fan assemblies, condenser, evaporator, liquid/gas circuit, throttling means, air inlets and air outlets and the apparatus being arranged such that the functions as condenser and evaporator are interchangeable for heating of air or cooling of air, respectively, in that the liquid flow in the liquid/gas circuit through the condenser, evaporator and throttling means is reversible according to requirements, wherein the apparatus comprises at least two separate units, a first main unit and a second annex unit, said units being interconnected via said liquid/gas circuit only, each said unit having a respective air heat exchanger that acts as a combined condenser/evaporator, fan assembly, fresh air inlet, indoor air inlet and mixing chamber upstream of the air heat exchanger, air outlet downstream of the air heat exchanger and independent means for redirecting the air flows; and wherein the apparatus includes at least first and second bypass loops in the liquid/gas circuit having closing and throttling means.

2. Apparatus according to claim 1, wherein the circulation of liquid through said main unit and said annex unit is reversible by way of a four-way valve.

3. Apparatus according to claim 1, wherein the liquid/gas circuit is connected to a water heat exchanger, for the additional function of heating water, or heating air where the energy is drawn from the water, and wherein a third bypass loop is provided in the liquid/gas circuit from the compressor.

4. Apparatus according to claim 1, wherein said main unit and said annex unit have a common compressor and are connected thereto via the liquid/gas circuit.

5. Apparatus according to claim 4, wherein said main unit and said annex unit are remote from one another, one of (1) at opposite ends of a room and (2) on separate floors, with the annex unit being located high and the main unit being located low in relation to each other.

6. Apparatus according to claim 1, wherein the apparatus is a compact unit wherein the main and annex units are placed adjacent to each other, one of (1) on top of each other and (2) next to each other, but are functionally interconnected solely by the liquid/gas circuit.

7. Apparatus according to claim 1, wherein the means for redirecting the air flows for both the main and annex units include at least two separate and through the apparatus extending ducts passing between a room in which the unit is disposed and the outside, and having a rotatable air redirection damper for directing the air through the heat exchangers, to and from the room or to and from the surroundings.

8. Apparatus according to claim 7, wherein the air redirection dampers are three-way dampers, coordinated pairs of orifice dampers or an equivalent thereto.

9. Apparatus according to claim 1, wherein means are included for closing off the flow of either outdoor air or indoor air through the fresh air inlet, by using either a damper.

10. Apparatus according to claim 1, wherein the throttling means are in the form of capillary tubes and the closing means are solenoid valves.

11. Method of multipurpose conditioning of indoor air, comprising ventilation, heating of air and cooling of air, in which fan assemblies cause air to flow through a conditioning apparatus that comprises a compressor, condensers, evaporators, liquid/gas circuit, throttling means, air inlets, air outlets and means for redirecting and closing off the air circulation, and in which the flow of liquid/gas can be reversed in order to interchange the functions of the condensers and the evaporators, the method comprising directing outdoor air, indoor air or a mixture of the two to an upstream side of at least two separate units, a main unit and an annex unit, each unit being interconnected via a liquid/gas circuit only, each unit having a respective combined condenser/evaporator, the air is drawn through respective condenser/evaporator by a respective fan assembly, and displaced further at the downstream side of the respective condenser/evaporator, towards a room, the surroundings or both by means of respective, independent redirection means.

12. A multipurpose air conditioning apparatus for ventilation, heating of air and cooling of air, comprising:

at least a first, main unit and a second, annex unit, each said unit having a respective air heat exchanger that acts as a combined condenser/evaporator, fan assembly, fresh air inlet, indoor air inlet, mixing chamber upstream of the air heat exchanger, air outlet downstream of the air heat exchanger, and independent means for redirecting the air flows;

said main unit further comprising a compressor and a first liquid/gas circuit for fluid flow to, through and from the condenser/evaporator and compressor, said annex unit further comprising a second liquid/gas circuit for fluid flow to, through and from the condenser/evaporator, said first and second liquid/gas circuits being fluidly interconnected, said main and annex units having independent air handling systems so that they are functionally interconnected solely via said interconnected liquid/gas circuits.

13. Apparatus according to claim 12, wherein the circulation of liquid/gas through said main unit and said annex unit is reversible by way of a four-way valve.

14. Apparatus according to claim 12, wherein the apparatus is a compact unit wherein the main and annex units are placed adjacent to each other, one of (1) on top of each other and (2) next to each other, but are functionally interconnected solely by the liquid/gas circuits.

15. Apparatus according to claim 12, wherein the means for redirecting the air flows for both the main and annex units include at least two separate and through the apparatus extending ducts passing between a room in which the unit is disposed and the outside, and having a rotatable air redirection damper for directing the air through the heat exchangers, to and from the room or to and from the surroundings.

16. Apparatus according to claim 15, wherein the air redirection dampers are three-way dampers, co-ordinated pairs of orifice dampers or an equivalent thereto.

* * * * *

UNITED STATES PATENT AND TRADEMARK OFFICE

CERTIFICATE OF CORRECTION

PATENT NO. : 6,385,983 B1
DATED : May 14, 2002
INVENTOR(S) : Sakki et al.

It is certified that error appears in the above-identified patent and that said Letters Patent is hereby corrected as shown below:

Title page

Item [76], Inventors, should be as follows:

-- [76] Inventors: Arnfinn Sakki, deceased, late of Kløfta, by Liv Sakki, heir; Laurits Mortensen, Rislokkeien 67 B, 0583 Olso; Erling Onsager, Holmenveien 63, 0376 Oslo; Alfred Brekke, Granstangen 28 c, 1051 Oslo. all of (NO) --

Signed and Sealed this

Twenty-ninth Day of April, 2003

JAMES E. ROGAN
*Director of the United States Patent and Trademark Office*